US007141011B2

(12) United States Patent
Williams et al.

(10) Patent No.: US 7,141,011 B2
(45) Date of Patent: Nov. 28, 2006

(54) EXERCISE APPARATUS

(75) Inventors: Terry Williams, New York, NY (US); Sue Hitzmann, New York, NY (US)

(73) Assignee: Body Language Fitness Co., LLC, New York, NY (US)

( * ) Notice: Subject to any disclaimer, the term of this patent is extended or adjusted under 35 U.S.C. 154(b) by 301 days.

(21) Appl. No.: 10/902,742

(22) Filed: Jul. 29, 2004

(65) Prior Publication Data

US 2006/0025291 A1 Feb. 2, 2006

(51) Int. Cl.
*A63B 71/00* (2006.01)

(52) U.S. Cl. ..... 482/148; 446/220

(58) Field of Classification Search ..... 482/140
See application file for complete search history.

(56) References Cited

U.S. PATENT DOCUMENTS 4,126,326 A 11/1978 Phillips
4,569,401 A 2/1986 Luck
4,822,038 A 4/1989 Maag
5,004,236 A 4/1991 Kameshima
5,192,259 A 3/1993 Budolfson
5,312,258 A 5/1994 Giorgio
5,632,707 A 5/1997 Daniel et al.
5,690,389 A 11/1997 Ekman et al.
5,728,031 A 3/1998 Honeycutt
5,735,776 A 4/1998 Swezey et al.
5,740,756 A * 4/1998 Ord ..... 116/173
5,769,757 A 6/1998 Fulks
5,810,700 A 9/1998 Orcutt
5,897,474 A 4/1999 Romero
6,000,944 A 12/1999 Schiefer
6,042,521 A 3/2000 De Giorgis
6,059,699 A 5/2000 Ramsey
6,068,580 A * 5/2000 Myers et al. ..... 482/93
6,117,054 A 9/2000 Soltanpour
6,151,715 A 11/2000 Doherty
6,152,865 A 11/2000 Beauvoir
6,190,292 B1 2/2001 Panes
6,309,328 B1 10/2001 Dudley
6,328,675 B1 12/2001 Kaye
6,375,601 B1 4/2002 Johnson
6,419,586 B1 7/2002 Chiu
6,425,843 B1 7/2002 Storfer et al.
6,461,284 B1 10/2002 Francavilla
6,461,285 B1 10/2002 Theunissen et al.
6,478,721 B1 11/2002 Hunter
6,517,471 B1 2/2003 Chen
6,547,703 B1 * 4/2003 Swezey et al. ..... 482/91
6,652,421 B1 11/2003 Chen
6,652,432 B1 11/2003 Smith
6,656,092 B1 12/2003 Fulks
6,666,802 B1 12/2003 Rasmussen
6,699,162 B1 3/2004 Chen
6,712,745 B1 3/2004 Lynne
6,730,005 B1 * 5/2004 Liao ..... 482/142

* cited by examiner

*Primary Examiner*—Lori Amerson
(74) *Attorney, Agent, or Firm*—Kenyon & Kenyon LLP

(57) ABSTRACT

A physio-ball including a shell and a support member attached to the shell. The support member is sufficiently rigid so as to support at least a portion of a user's body when the portion of the user's body is in contact with the support member.

22 Claims, 1 Drawing Sheet

EXERCISE APPARATUS

FIELD OF THE INVENTION

The present invention relates to an exercise apparatus, and more particularly to a physio-ball.

BACKGROUND

Physio-balls, also known as "Swiss balls" or stability balls, are a popular type of exercise apparatus for promoting balance, flexibility, strength and alignment. Physio-balls are typically spherical, cylindrical or ovoid-shaped balls that have a vinyl outer coating. They are filled with air or some other type of fluid in order to provide a moderate degree of flexibility and compressibility when sat on by a user or when pressed upon by a user during use.

A physio-ball may be used in many different ways. For instance, a physio-ball may be used as a seat when exercising, e.g., a user may sit on top of the physio-ball while performing sit-ups or some other type of movement of the upper body relative to the lower body. Alternatively, a user may balance a portion of her body, e.g., her feet or her hands, on the ball, thereby forcing the user to balance that portion of the body during the performance of an exercise. For instance, a user may position her feet, or her hands, on top of the physio-ball while performing push-ups, lunges, hip lifts, etc.

A physio-ball provides several advantages. For example, a physio-ball is typically semi-firm, and thus conforms somewhat with a user's body when being used. Thus, less pressure or contact is experienced by a user when performing an exercise with a physio-ball as compared to performing the same exercise on a conventional hard surface. Furthermore, a physio-ball may roll in one or more directions, thereby promoting balance and developing muscles that contribute to the user's stability and strength. Still further, the rolling motion of the physio-ball against the user's muscles may facilitate myofascial flexibility and release.

SUMMARY

The present invention relates to a physio-ball including a shell and a support member attached to the shell. The support member is sufficiently rigid so as to support at least a portion of a user's body when the portion of the user's body is in contact with the support member.

The shell of the physio-ball may be inflatable, and may be, for instance, spherical, cylindrical or ovoid in shape. Preferably, the shell of the physio-ball is about 55 cm, 65 cm or 75 cm in diameter and is comprised of a non-latex material. The shell is preferably filled with air or another type of fluid such that the physio-ball has a moderate degree of compressibility during use.

The support member may be a ring with a circular cross-section, may be curved or straight, may have the form of a rim, a lip, a handle, or any other shape. The support member may fully encircle the shell, although it may instead extend around one or more portions of the shell, each portion extending less than the full circumference of the shell, e.g., disposed in symmetrical fashion around the circumference of the physio-ball. Furthermore, the support member may be positioned at approximately the vertical midpoint of the shell, or else may be positioned above or below the vertical midpoint of the shell.

Additional features of the physio-ball of the present invention are discussed in greater detail below.

DETAILED DESCRIPTION

The present invention, according to one embodiment thereof, is directed to a physio-ball that includes a support member.

Figure 1:
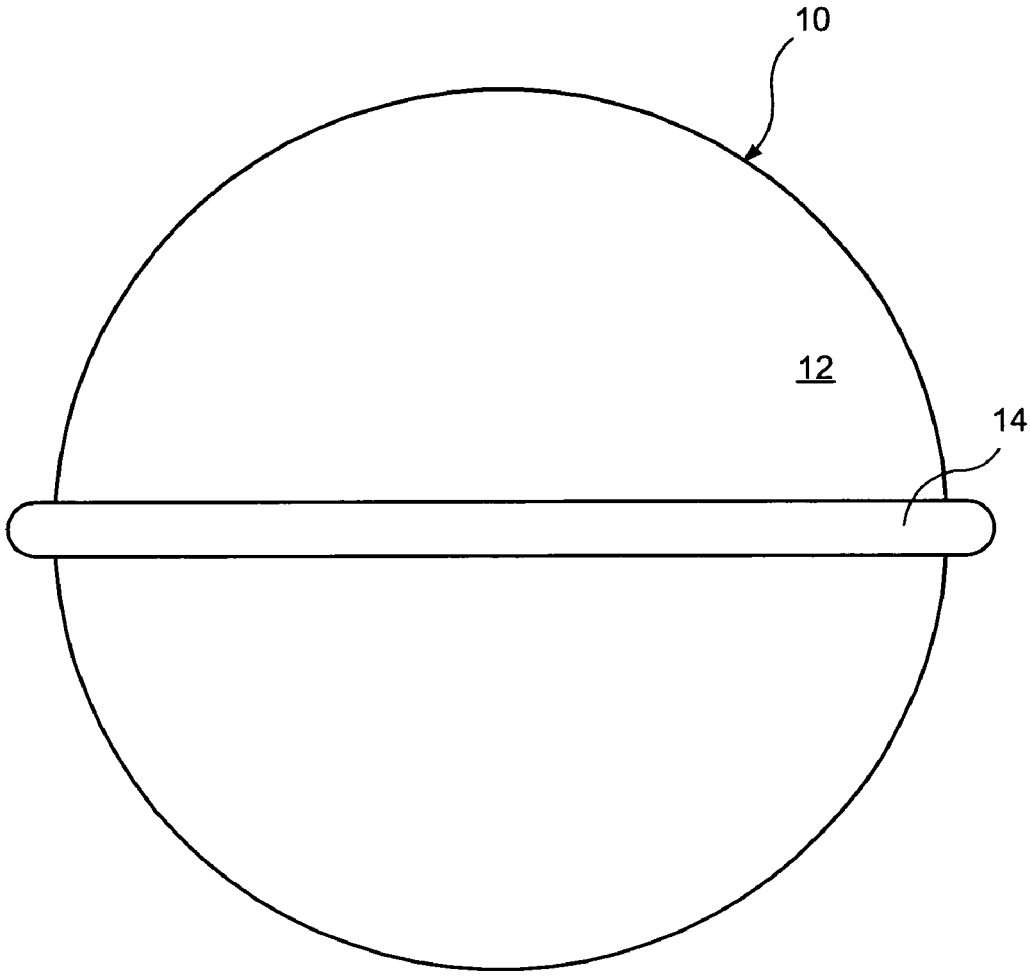
FIG. 1 is a side view of a physio-ball, according to one embodiment of the present invention.

FIG. 1 is a side view of a physio-ball 10, according to one embodiment of the present invention. The physio-ball 10 includes a shell 12. Advantageously, the shell 12 is inflatable such that the physio-ball may be inflated for use and may be deflated for storage purposes. The shell 12 is preferably spherical in shape when inflated, although any other shape, e.g., cylindrical, ovoid, etc., may also be employed. Preferably, the shell 12 is 55 cm, 65 cm or 75 cm in diameter, although any sizes may be employed. The shell 12 may be comprised of vinyl or latex, but preferably is comprised of a non-latex material. The shell 12 is filled with air or another type of fluid in order to provide a moderate degree of flexibility and compressibility when sat on by a user or when pressed upon by a user.

Figure 2:
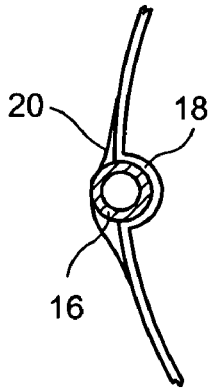
FIG. 2 is a side, cross-sectional view of a support member for a physio-ball, according to one embodiment of the present invention.

The physio-ball 10 also includes a support member 14. The support member 14 functions to provide a user with a surface, other than the surface of the shell 12, that assists the user in balancing or supporting him or herself when using the physio-ball. For instance, FIG. 2 is a cross-sectional view of the support member 14 according to one embodiment of the present invention. In this embodiment, the support member 14 is a ring 16 having a circular cross-section. Additional features illustrated in FIG. 2 are discussed further below. It should be recognized that, while FIG. 2 illustrates the support member 14 in the shape of a ring having a circular cross-section, the support member 14 may have any shape that is capable of assisting the user in balancing or supporting him or herself when using the physio-ball. For instance, the support member 14 may be curved, straight or any other shape, and/or may be in the form of a rim, lip, a handle, etc.

FIG. 1 illustrates that, in one embodiment, the support member 14 fully encircles the shell 12. Alternatively, the support member 14 may extend around one or more portions of the shell 12, each portion extending less than the full circumference of the shell 12. If the support member 14 does not fully encircle the shell 12 but instead extends around one or more portions of the shell 12, those portions are advantageously disposed in symmetrical fashion around the circumference of the physio-ball 10, so as to provide balance when used.

FIG. 1 illustrates that the support member 14 is positioned at approximately the vertical midpoint of the shell 12. In this manner, the support member 14 is positioned at the widest diameter of the physio-ball 10. In other embodiments, the support member 14 may be positioned above or below the vertical midpoint of the shell 12. Furthermore, FIG. 1 illustrates that the support member 14 is positioned at a single vertical location of the shell 12. In other embodiments, the physio-ball 10 may have more than one support member 14, each support member 14 being positioned at a different vertical location, e.g., at, above or below the vertical midpoint, of the shell 12.

FIG. 2 illustrates that, in one embodiment, the support member 14 is configured to be engaged with a recess 18 of the shell 12. In this manner, the support member 14 is at least partially supported by the shell 12. Alternatively, the shell 12 may have an projection rather than a recess, the projection operating to engage the support member 14 for the purpose of attaching the support member 14 to the shell. Still further, the shell 12 may have neither a recess nor a projection, but rather may be sized and shaped relative to the support member 14 such that the support member 14 is maintained in position on the shell 12 by friction.

The support member 14 may be formed of a rigid plastic or PVC material. Other materials may also be employed.

The support member 14 may be permanently attached to the shell 12. For instance, FIG. 2 illustrates one embodiment in which the support member 14 is integrated within the shell 12 by being disposed within a recess 18 and being kept within the recess 18 by an outer shell 20 that is permanently attached to the shell 12. In another embodiment, the support member 14 is attached by glue, velcro, or some other type of adhesive. Alternatively, the support member 14 may be removable from the shell 12 such that the physio-ball 10 may be used with or without the support member 14.

The physio-ball 10 of the present invention, in accordance with various embodiments described hereinabove, may be used in many different ways. For instance, the physio-ball 10 may be used as a seat, e.g., a user may sit on top of the physio-ball while performing sit-ups or some other type of movement of the upper body relative to the lower body. In addition, a user may balance a portion of her body, e.g., her feet or her hands, on the ball, thereby forcing the user to balance that portion of the body during the performance of an exercise. For instance, a user may position her feet, or her hands, on top of the physio-ball while performing push-ups, lunges, hip lifts, etc.

The physio-ball 10 of the present invention, in accordance with various embodiments described hereinabove, has several advantages over conventional physio-balls. For instance, the physio-ball 10 enables a user to grasp the support member 14 with her hands, thus reducing the likelihood that her hands will slip off of the physio-ball during use. Furthermore, the physio-ball 10 enables a user to position her feet on the support member 14, e.g., by standing on top of the support member 14, by resting her feet on the support member 14 while performing push-ups, etc., thus reducing the likelihood that her feet will slip off of the physio-ball during use.

Thus, the several aforementioned objects and advantages of the present invention are most effectively attained. Those skilled in the art will appreciate that numerous modifications of the exemplary embodiment described hereinabove may be made without departing from the spirit and scope of the invention. Although various exemplary embodiments of the present invention has been described and disclosed in detail herein, it should be understood that this invention is in no sense limited thereby.

What is claimed is:

1. A physio-ball comprising:

a shell;

a support member attached to the shell, the support member being sufficiently rigid so as to support at least a portion of a user's body when the portion of the user's body is in contact with the support member, wherein the support member is at least a portion of a ring that forms a rim or lip on an outer circumference of the shell.

2. The physio-ball of claim 1, wherein the shell is inflatable.

3. The physio-ball of claim 1, wherein the shell is one of spherical, cylindrical and ovoid in shape.

4. The physio-ball of claim 1, wherein the shell is one of about 55cm, 65cm and 75cm in diameter.

5. The physio-ball of claim 1, wherein the shell is comprised of a non-latex material.

6. The physio-ball of claim 1, wherein the shell is filled with at least one of air and another type of fluid such that the physio-ball has a moderate degree of compressibility during use.

7. The physio-ball of claim 1, wherein the support member is a ring.

8. The physio-ball of claim 1, wherein the support member has a circular cross-section.

9. The physio-ball of claim 1, wherein the support member is one of curved and straight.

10. The physio-ball of claim 1, wherein the support member is in the form of one of a rim, a lip, and a handle.

11. The physio-ball of claim 1, wherein the support member fully encircles the shell.

12. The physio-ball of claim 1, wherein the support member extends around one or more portions of the shell, each portion extending less than the full circumference of the shell.

13. The physio-ball of claim 12, wherein each portion of the support member is disposed in symmetrical fashion around the circumference of the physio-ball.

14. The physio-ball of claim 1, wherein the support member is positioned at approximately the vertical midpoint of the shell.

15. The physio-ball of claim 1, wherein the support member is positioned one of above and below the vertical midpoint of the shell.

16. The physio-ball of claim 1, wherein the support member is positioned at a single vertical location of the shell.

17. The physio-ball of claim 1, wherein the physio-ball has more than one support member, each support member being positioned at a different vertical location of the shell.

18. The physio-ball of claim 1, wherein the physio-ball has a recess, the support member being engaged with the recess.

19. The physio-ball of claim 1, wherein the physio-ball has a projection, the support member being engaged with the projection.

20. The physio-ball of claim 1, wherein the support member is maintained in position on the shell by friction.

21. The physio-ball of claim 1, wherein the support member is permanently attached to the shell.

22. The physio-ball of claim 1, wherein the support member is detachable from the shell.

* * * * *